US006474205B1

(12) United States Patent
Halmschlager et al.

(10) Patent No.: US 6,474,205 B1
(45) Date of Patent: Nov. 5, 2002

(54) DEVICE FOR CUTTING OFF AND CONVEYING STREAKS AND METHOD FOR CUTTING OFF AND TRANSFERRING A THREADING STREAK

(75) Inventors: Guenter Halmschlager, Rohrendorf (AT); Peter Haider, St. Polten (AT); Herbert Haunlieb, Loosdorf (AT)

(73) Assignee: Voith Sulzer Papiertechnik Patent GmbH, Heindenheim (DE)

( * ) Notice: Subject to any disclaimer, the term of this patent is extended or adjusted under 35 U.S.C. 154(b) by 0 days.

(21) Appl. No.: 09/381,965

(22) PCT Filed: Apr. 1, 1998

(86) PCT No.: PCT/EP98/01878

§ 371 (c)(1),
(2), (4) Date: Nov. 17, 1999

(87) PCT Pub. No.: WO98/43815

PCT Pub. Date: Oct. 8, 1998

(30) Foreign Application Priority Data

Apr. 1, 1997 (DE) ..... 197 13 540

(51) Int. Cl.[7] ..... B65H 16/00; B26D 7/14

(52) U.S. Cl. ..... 83/24; 83/51; 83/56; 83/98; 83/102; 83/110; 83/156; 83/157; 83/382; 83/436.9; 83/436.75; 83/909; 83/949; 242/522; 242/562.1; 226/91; 57/31; 162/120; 162/193; 162/194

(58) Field of Search ..... 83/24, 27, 33, 83/51, 56, 949, 909, 98, 102, 110, 156, 157, 373, 374, 375, 382, 436.9, 436.75, 456; 242/562.1, 523.1, 522; 226/91; 162/120, 193, 194, 287; 57/31

(56) References Cited

U.S. PATENT DOCUMENTS

| | | | | | |
|---|---|---|---|---|---|
| 1,301,123 | A | * | 4/1919 | Goss | 242/562.1 X |
| 3,395,639 | A | | 8/1968 | Swan | 101/483 |
| 3,529,755 | A | * | 9/1970 | Spangenberg et al. | 83/27 X |
| 4,117,989 | A | * | 10/1978 | Petros | 242/562.1 |
| 4,276,735 | A | * | 7/1981 | Miyazaki | 242/562.1 X |
| 4,437,223 | A | * | 3/1984 | Petros | 83/909 X |
| 4,597,316 | A | * | 7/1986 | Ichikawa | 83/156 |
| 4,611,518 | A | * | 9/1986 | Hildebrandt | 83/373 X |
| 4,787,546 | A | | 11/1988 | Bradbury | 226/91 |
| 4,840,320 | A | * | 6/1989 | Shigeta et al. | 242/562.1 X |
| 4,923,567 | A | * | 5/1990 | Liedes et al. | 242/562.1 X |
| 4,984,750 | A | * | 1/1991 | Shigeta et al. | 424/562.1 X |
| 5,275,673 | A | * | 1/1994 | Suzuki et al. | 242/562.1 X |
| 5,397,424 | A | * | 3/1995 | Sakano et al. | 242/562.1 X |
| 5,816,149 | A | * | 10/1998 | Kagawa et al. | 242/562.1 X |

FOREIGN PATENT DOCUMENTS

| | | |
|---|---|---|
| DE | 9202092 | 5/1992 |
| DE | 9206844 | 9/1992 |
| DE | 9208419 | 9/1992 |
| EP | 0359396 | 3/1990 |
| GB | 2073712 | 10/1981 |
| GB | 2097766 | 11/1982 |

OTHER PUBLICATIONS

Copy of the PCT/IPEA/409 form.
Copy of the PCT/IPEA/416 form.

* cited by examiner

*Primary Examiner*—Charles Goodman
(74) *Attorney, Agent, or Firm*—Greenblum & Bernstein, P.L.C.

(57) ABSTRACT

The invention relates to a device for cutting off and conveying strips, for a machine. The device is used for producing a continuous web, especially of paper or card, for a threading strip, and has a knife. Finally the device is characterized in that it has it least one (preferably driven) guiding roll (27) which can be brought into engagement with the threading strip (27).

46 Claims, 2 Drawing Sheets

DEVICE FOR CUTTING OFF AND CONVEYING STREAKS AND METHOD FOR CUTTING OFF AND TRANSFERRING A THREADING STREAK

BACKGROUND OF THE INVENTION

1. Field of the Invention

The invention relates to a device for cutting and transferring strips (streaks) which functions with a machine for producing a continuous material web, in particular a paper or cardboard web, and further relates to a method for cutting and transferring a threading strip inside a machine for producing a continuous material web, in particular a paper or cardboard web.

2. Description of Background and Relevant Information

Devices and methods of the type claimed here are known. They are used to introduce the web into the machine when starting the machine for producing, a continuous material web. Because the material web can be up to 8 to 10 meters wide, it is practically impossible to thread it simultaneously across its entire width. Therefore, a so-called insertion or threading strip, which is also called a belt, is cut from the material web. The threading strip is significantly narrower than the entire material web, for example, it is approximately 30 cm wide. This threading strip is threaded into the machine and, in the end, draws the entire width of the material web along with it. The threading process takes place, for example, when starting the paper machine or after a web tear.

At the beginning of a threading process, the threading strip, together with the rest of the material web, runs freely, i.e., it is conveyed away from the first drying cylinder. for example, of a drying section of the machine for producing a material web into the basement of the machine and is supplied to an additional treatment. In order to be able to guide the threading strip through the machine, it must first be severed, i.e., cut. At the beginning of the threading process, since the material web or its threading strip is traveling at the full machine running speed or at least is traveling at a speed that is only reduced by an insignificant amount, a back-up occurs during the cutting process due to which a further transfer of the threading strip is frequently problematic.

SUMMARY OF THE INVENTION

Therefore, the object of the invention is to produce a device for cutting and transferring strips as well as a method for cutting and transferring a threading strip which do not have this disadvantage and assure an optimal cutting and transfer of the threading strip.

This object is attained with the aid of a device for cutting and transferring strips which has the features that will be herein described. The device is distinguished by means of at least one guide roll which is brought into engagement with the free-running threading strip and conveys it to the cutting point. It is therefore possible to prevent a paper backup when cutting the material web and to assure a trouble-free transfer of the threading strip.

A preferable exemplary embodiment of the strip cutting and transferring device is distinguished by the fact that the guide roll cooperates with a clamping device which preferably includes at least one clamping roll. This cooperation of the two rolls improves the guidance of the threading strip so that this makes a further contribution to the clean cutting and transfer of the threading strip.

Another preferable embodiment of the strip cutting and transferring device is distinguished by the fact that the rotation speed of the guide roll and/or of the clamping roll can be adjusted so that their circumferential speed is at least as high as the traveling speed of the threading strip. Since the two rolls engage each other, they basically rotate at the same speed. It is therefore sufficient to drive one of the two rolls and to choose to have the circumferential speed of one of the two rolls be adjustable. Because of the adjustable rotation speed, the tension of the threading strip can be adjusted to a desired value so that a definite cutting process and a clean transfer of the threading strip are assured.

A particularly preferable embodiment of the strip cutting and transferring device is distinguished by the fact that the knife used for the cutting process is moveable. It is therefore possible to select the knife movement so that it travels in the transfer direction of the threading strip. As a result, the flee front end of the threading strip produced by the cutting process is deflected into the direction in which the threading strip is to be transferred.

In order to attain the object, a method for cutting and transferring a threading strip inside a machine for producing a continuous material web is proposed, which has the features mentioned herein. It is distinguished by the fact that the threading strip is supplied to the cutting point before the cutting. As a result of the defined position of the threading strip during the cutting, a paper back-up as well as transfer problems can be prevented.

A preferable embodiment of the method is distinguished by the fact that the threading strip is subjected to a definite initial tension before the cutting. This leads to a further improvement of the behavior of the threading strip when cutting. A back-up can be reliably prevented so that problems in the transfer of the cut strip end are practically eliminated.

Finally, another preferable embodiment of the method is distinguished in that the threading strip is cut by a knife which, for the cutting, is moved in the same direction as the free end of the strip end being cut. The free end of the threading strip produced in the cutting process thus receives an impetus in the direction of the subsequent travel of the threading strip. The method is therefore distinguished by a very high degree of operational safety.

BRIEF DESCRIPTION OF THE DRAWINGS

The invention will be explained in detail below in conjunction with the drawings.

DETAILED DESCRIPTION OF THE INVENTION

The strip cutting and transferring device and the method for cutting and transferring a threading strip that are described below can basically be used in connection with any machine for producing a continuous material web. For the sake of example, it is assumed below that this machine is a paper making machine.

Figure 3:
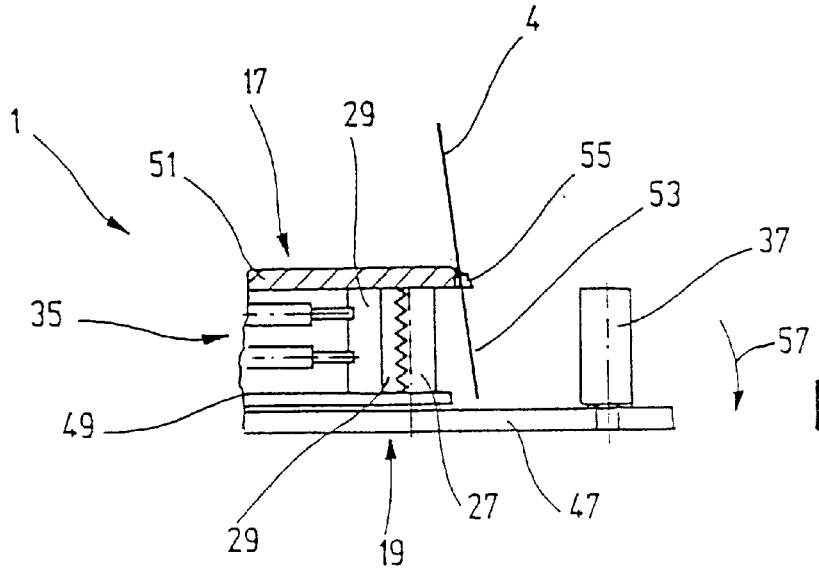
FIG. 3 shows a top view of a part of the strip cutting and transferring device.

FIG. 3*a* is an alternative embodiment of the arrangement depicted in FIG. 3; and FIG. 4 illustrates a view facing the nozzle.

The strip cutting and transferring device and the method for cutting and transferring a threading strip that are described below can basically be used in connection with any machine for producing a continuous material web. For the sake of example, it is assumed below that this machine is a paper masking machine.

When starting the machine, for example, when commencing production or after a web tear, the continuous material web is first conveyed away in its full width into the so-called basement of the machine and is later supplied to an additional treatment apparatus. A relatively narrow strip is cut from the material web with the aid of a known cutting device. First, the remaining material web and the cut strip, which later constitutes the threading strip, are permitted to fall into the basement. The strip cutting and transferring device is disposed at the point where the material web and the threading strip exit fiord a cylinder of the paper making machine, for example, a drying cylinder.

Upon activation of the strip cutting and transferring device, the threading strip is cut and the free end of the threading strip thus produced is threaded into the subsequent parts of the paper making machine. If the strip travels reliably inside the machine, the cutting device is moved so that the width of the threading strip becomes continually greater and therefore draws an ever wider strip of the material web through the machine. Finally, the entire width of the material web is thus conveyed through the machine.

Figure 1:
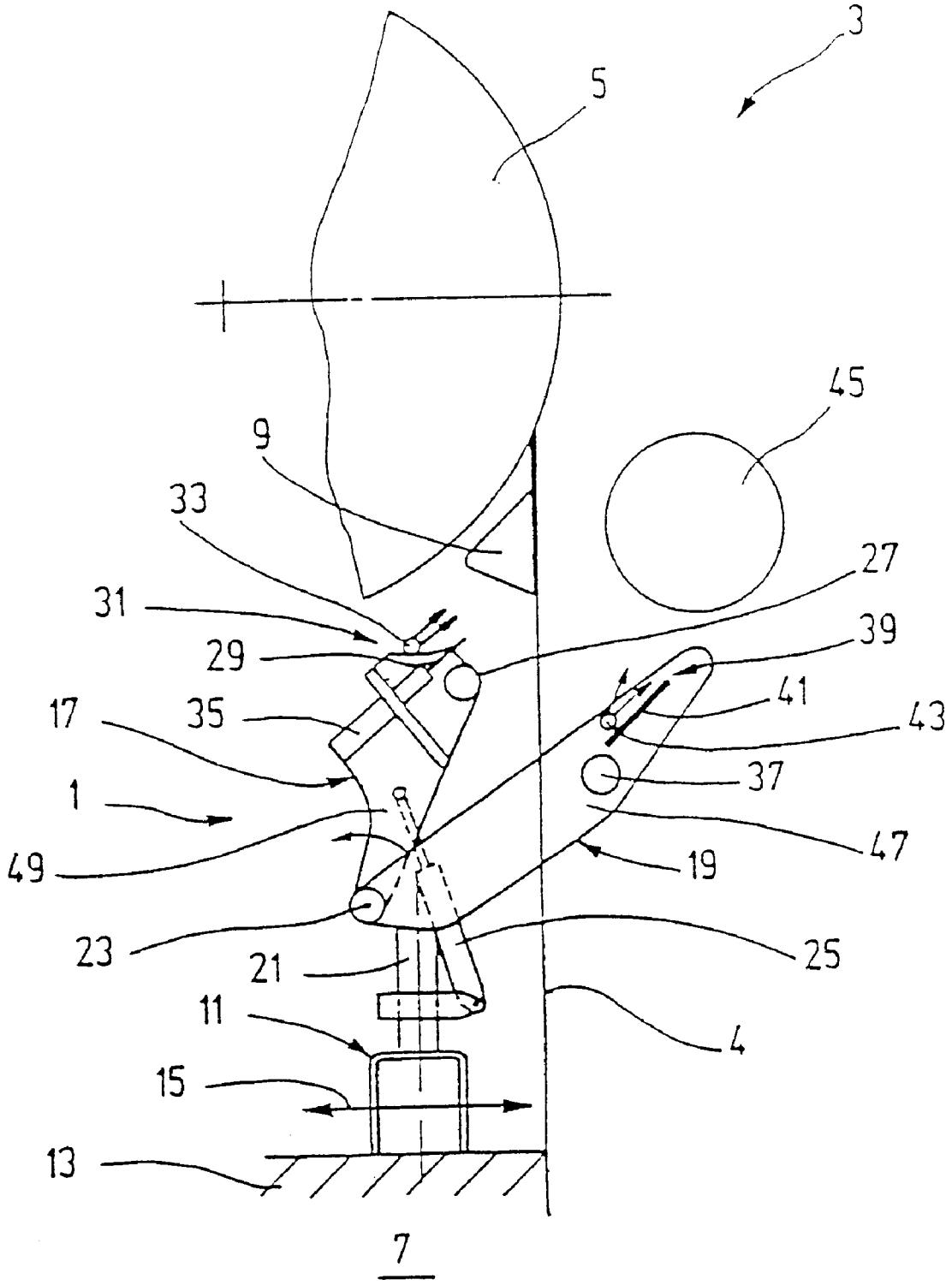
FIG. 1 shows a schematic representation of a strip cutting and transferring device in a first functional position.

The schematic depiction according to FIG. 1 shows a strip cutting and transferring device that is referred to below as the device 1 for short, which is integrated into a machine 3 for producing a continuous material web 4 and/or paper web. In the funtional position of the device 1 that is shown in FIG. 1, the material web 4 runs freely downward from a drying cylinder 5 of the machine 3, following gravity, anad travels into a basement 7. From there, the material web is supplied to a further treatment apparatus. The nateruak web 4 is picked up from the surface of the drying cylinder 5 with the aid of a doctor 9, which is basically known so that its function and design are not discussed in detail here.

The device 1 includes a base 11, which can be moved in the manner indicated by a double arrow 15. for example, on a foundation beam 13. A carrying device 17 is attached to the base 11 and cooperates with a counter support 19 which is likewise attached to the base 11. In the exemplary embodiment shown here, the counter support 19 is connected to the base 11 by way of a pipe 21. The carrying device 17 is fastened in an articulating fashion to the counter support 19 by a pivot axle 23. A pivoting motion of the carrying device 17 in relation to the counter support 19 is produced, for example, by a piston/cylinder unit 25, also called a pivoting cylinder, whose operation and function are basically known. The piston/cylinder unit 25 is suitably fastened to the pipe 21 on one side and to the carrying device 17 on the other side.

The pipe 21 is embodied so that it can be rotated in relation to the base 11. This means that the carrying device 17 and the counter support 19 of the device 1 are disposed so that they can be moved and rotated in relation to the foundation beam 13.

A guide roll 27 and a knife 29 are fastened to the carrying device 17. Finally, another guide device 31 is also provided here which, in this instance, includes at least one air nozzle 33, if necessary a plurality of air nozzles 33 distributed across the width of the threading strip.

The knife 29 is supported so that it can move in relation to the carrying device 17. It cooperates with a piston/cylinder device 35, which is connected to the knife 29 on one side and is suitably connected to the carrying device 17 on the other side.

The counter support 19 is provided with a clamping device and a guide device 39. The latter includes a guide plate 41 and at least one air nozzle 43. In this exemplary embodiment, the clamping device is constituted by a clamping roll 37. In another exemplary embodiment (not shown), the clamping device includes a number of clamping rolls. Alternatively, it is also possible that instead of at least one clamping roll, the clamping device includes a guide device, for example, with a contact surface for the threading strip that is curved if necessary.

Above the counter support 19, a web guide roll 45 is disposed onto which the threading strip, which is cut from the material web 4, is to be guide.

The counter support 19 has a side wall 47 which is connected to the pipe 21 and encloses the pivot axle 23 on its one end—on the left in FIG. 1. The clamping roll 37 is disposed at a distance from the pivot axle 23 so that the threading strip, which has been cut from the material web 4, can travel downward between the pivot axle 23 and the clamping roll 37. The guide plate 41 and the air nozzle 43 are disposed on the side of the clamping roll 37 remote from the pivot axle 23 and are situated between this clamping roll and the web guide roll 45. The air nozzle 43 is embodied so that it produces one or a number of air jets which extend essentially parallel to the guide plate 41 and are directed toward the web guide roll 45.

The carrying device 17 includes a first carrying arm 49 which cooperates with the pivot axle 23 so that the carrying device 17 is pivotably connected to the counter support 19. On the end of the carrying arm 49 opposite from the pivot axle 23 the guide roll 27 is rotatably supported on the carrying aria 49.

In the exemplary embodiment of the device 1 shown here, the counter support 19 is firmly connected to the pipe 21 in a stationary fashion while the carrying device 17 can be pivoted in relation to the counter support 19 and therefore in relation to the pipe 21. In the functional position shown in FIG. 1, the carrying device 17 is pivoted upward counterclockwise so that the guide roll 27 and the clamping roll 37 are disposed at such a distance that the threading strip cut from the material web 4 can travel between the two rolls into the basement 7.

Figure 2:
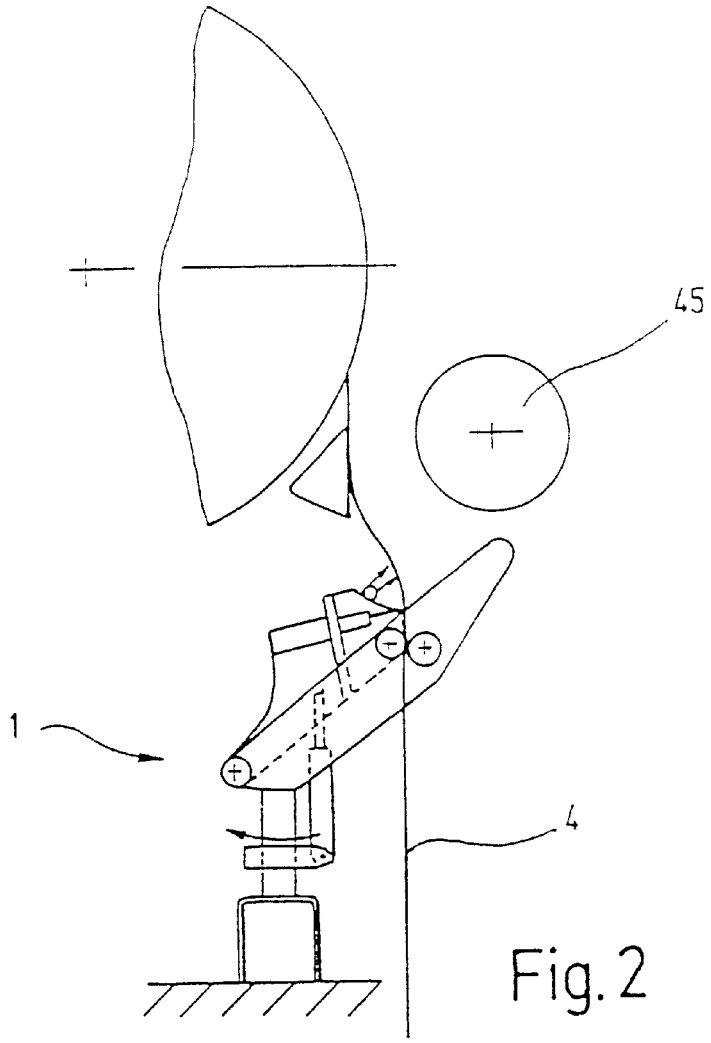
FIG. 2 shows a schematic representation of the strip cutting and transferring device in FIG. 1, in a second functional position.

FIG. 2 shows the device 1 in its second functional position: through activation of the piston/cylinder unit 25, the carrying device 17 is pivoted clockwise in relation to the stationary counter support 19 so that the guide roll 27 moves into the movement path of the threading strip of the material web 4 running freely from the doctor 9 into the basement 7, The threading strip is therefore deflected toward the right by the guide roll 27.

If the guide roll 27 is embodied as being driven, then it can guide the threading strip of the material web 4 so that the threading strip is stabilized. With another pivoting movement of the carrying device 17, the guide roll 27 finally comes into contact with the clamping roll 37. As a result, the threading strip of the material web is clamped between the guide roll 27 and the clamping roll 37 and reliably guided by them.

The guide roll 27 is driven with such a rotation speed that the circumference speed of the guide roll 27 at least corresponds to the traveling speed of the threading strip. Preferably, the rotation speed is selected so that the circumference surface of the guide roll 27 leads the threading strip to a certain extent and acts on it with an initial tension. A definite initial tension of the threading strip can be achieved, particularly when the threading strip is clamped between the guide roll 27 and the clamping roll 37.

The knife 29 is fastened to the carrying device 17 so that it can be brought into engagement with the threading strip of the material web 4 and cuts this threading strip. The guide device 31 is embodied so that its at least one air nozzle 33 acts on the threading strip of the material web 4 with an air current which acts on the left side of the threading strip—in FIG. 2—and exerts a force on it which acts in the direction of the web guide roll 45.

FIG. 3 is a top view of a part of the device 1, in the first functional position shown in FIG. 1. The side wall 47 of the counter support 19 is visible, on the right end of which the clamping roll 37 is supported in a cantilevered fashion. The carrying, arm 49 of the carrying device 17 is also visible. The top view also shows that another carrying arm 51 is associated with the carrying arm 49 and is disposed on the opposite side. The guide roll 27 is rotatably supported between the carrying arms 49 and 51. The depiction of the drive mechanism for the guide roll 27 has been omitted here. The knife 29 is supported so that it can be moved in relation to the carrying arms 49 and 51. The movement of the knife 29 is produced by the piston/cylinder unit 35 which in this instance includes two individual elements which each have a piston and a cylinder and arc coupled to the knife 29.

FIG. 3 shows the lateral edge region of the material web 4 from which the threading strip 53 is cut by a cutting device that is not shown here. In order to assure a reliable function of the device 1. a separating device is provided here on the carrying arm 51 and has a projection 55 which assures that the threading strip 53 is guided between the projection 55 and side wall 47 while the remaining part of the material web travels outside the device 1. Therefore. a distance is provided between the threading strip 53 and the rest of the material web 4.

FIG. 3 is greatly simplified insofar as the depiction of a possible drive mechanism for the clamping roll 37 and the depiction of the guide device 39 have been omitted. Finally, the guide device 31 has also not been depicted here in order to permit a clear view of the knife 29.

The function of the device 1 shown in FIGS. 1 to 3 and the method for cutting and transferring a threading strip will be discussed in detail below:

First, as indicated above, the material web 4 is conveyed in its full width away from the drying cylinder 5, for example, into the basement 7 of the machine 3. In this operational phase, the device 1 is disposed in its first functional position which is shown in FIG. 1. This means that the guide roll 27 and the clamping roll 37 are disposed at such a distance from each other that the threading, strip 53 can travel unhindered away from the doctor 9 into the basement 7. In this phase, the threading strip 53 does not touch either the guide roll 27 or the clamping roll 37.

The carrying device 17 is now pivoted clockwise with the aid of the piston/cylinder unit 25. As a result, the projection 55 engages with the material web 4 so that the threading strip 53 is assured of traveling at a distance from the rest of material web 4. With another pivoting motion, the guide roll 27 comes into contact with the traveling threading strip. The guide roll 27 is preferably driven and rotates with a speed that corresponds to, and is preferably greater than, the traveling speed of the threading strip 53. This produces a guidance of the threading strip 53.

With another pivoting motion of the carrying device 17, the threading strip 53 is finally deflected against the clamping roll 37 and is clamped between the guide roll 27 and the clamping roll 37. These rolls rotate with such a speed that the threading strip 53 is reliably guided and is preferably acted on with an initial tension.

Due to the mobility of the base 11, it is possible to assure that in the first functional position of the device 1, which is shown in FIG. 1, the threading, strip 53 travels freely between the guide roll 27 and clamping roll 37.

As soon as the treading, strip 53 is clamped securely between the guide roll 27 and the clamping roll 37 and has been supplied with an initial tension, the knife 29 can be activated by the piston/cylinder unit 35 and moved toward the right—according to the view in FIG. 3. As a result, the knife 29, which is embodied here as serrated, cuts the threading strip without creating a back-up. The cutting motion of the knife 29 occurs from left to right so that the threading strip 53 is acted on with an impetus directed toward the right. Through activation of the guide device 31, which has at least one air nozzle 33, an additional force directed toward the right is exerted on the free end of the threading strip 53 produced by the cutting process so that the free end travels to the guide device 39. The free end of the threading strip 53 is guided on the guide plate 41 there to the web guide roll 45 and is additionally acted on with a guidance force which is produced by the air nozzle(s) 43.

A reliable transfer of the free end of the threading strip 53 produced in the cutting is assured because of the fact that the guide roll 27 supplies the threading strip 53 to the cutting. A back-up before the knife 29 can be avoided even at the top machine speed particularly by virtue of the fact that the threading strip 53 is acted on with an initial tension before the cutting so that the free end produced is acted on with an impetus directed in the transfer direction right during the cutting process and is reliably conveyed onward by guide devices.

The device 1 and the method described here are distinguished not only by a high degree of functional reliability but also by a high degree of operational safety. This is also assured by the fact that the knife 29 is disposed protected between the carrying arms 49 and 51 and that the knife can be moved and brought into a retracted position as soon as a cutting process is finished. The danger of injury is thus reduced to a minimum.

The device 1 is also simply designed and can be brought into an optimal operating position because of the mobile base 11 and because of the ability to rotate the pipe 21. It is therefore possible, for example, to rotate the device 1 slightly, i.e., to align it not exactly parallel to the travel direction of the material web 4. Therefore, the threading strip 53 produced can be supplied to cable tongs, not shown here, which are provided immediately adjacent to the material web 4. These cable tongs are basically known and are used to draw the threading strip 53 through the machine for producing the material web. Naturally, the device 1 can also be used in a machine for producing a material web in which a cable-free system is used in order to guide or draw the threading strip through the machine, for example, an air threading system. This system is known per se and therefore a detailed description has been omitted.

The clockwise pivoting movement of the device 1, which is used to introduce the threading strip 53 into cable tongs in this exemplary embodiment shown in FIGS. 1 to 3, is indicated by an arrow 57 in FIG. 3.

Due to the mobility of the device 1, after the threading strip 53 is threaded, it is possible to move the device 1 so that, in the event of a web tear, it does not hinder the material web 4 from coming, off of the drying cylinder 5.

In the end, it is clear that the device 1 can also be modified insofar as the carrying device 17 can be embodied as stationary and the counter support 19 can be embodied so that it can pivot. The essential element is that in a first functional position, the threading, strip can travel freely between a guide roll and a clamping roll and, in a second functional position, this threading strip can be reliably guided and acted on with an initial tension. It is also immaterial in this connection whether the guide roll or the clamping roll is driven in order to produce the initial tension.

What is claimed is:

1. A method for cutting and transferring a threading strip inside a machine for producing a continuous material web, the material web comprising one of a paper or cardboard web, using a device for cutting and transferring a threading strip, comprising:

moving a driven guide roll and a clamping roll into a movement path of the threading strip traveling from a cylinder of the machine for producing a continuous material web into a basement;

cutting the threading strip in an area of the device between the cylinder and each of the driven guide roll and the clamping roll;

transferring the threading strip to a part of the device disposed downstream from the driven guide roll in a web travel direction; and guiding the threading strip away from the continuous material web using an air flow after the threading strip is cut.

2. The method of claim 1, further comprising subjecting the threading strip to a definite initial tension before the cutting.

3. The method of claim 1, wherein the cutting comprises cutting the threading strip with a knife which is moveable.

4. A method for cutting and transferring a threading strip from a web downstream of a cylinder comprising:

removing the web from the cylinder, the web comprising the threading strip and a remaining portion;

clamping the threading strip between a pivoting carrying device having a driven guide roll and a counter support having a clamping device;

cutting the threading strip to form a threading end, the cutting comprising engaging the threading strip with a knife which is moveable in a direction parallel to a center axis of the driven guide roll; and directing the threading end in a direction different than the remaining portion, wherein the threading strip is guided away from the remaining portion using an air flow, wherein the threading strip is cut in an area between the cylinder and each of the driven guide roll and the clamping device.

5. The method of claim 4, wherein the clamping comprises pivoting the carrying device towards the clamping device until the threading strip is trapped between the driven guide roll and the clamping device.

6. The method of claim 5, further comprising:

rotating the carrying device on a base.

7. The method of claim 5, further comprising:

moving the carrying device with respect to a base which is moveably fixed to a support surface.

8. The method of claim 5, further comprising:

deflecting the web with the driven guide roll during the pivoting.

9. The method of claim 8, further comprising:

rotatably driving the driven guide roll before the clamping of the threading strip.

10. The method of claim 9, wherein the driven guide roll is rotatably driven at a speed which substantially corresponds to a traveling speed of the threading strip whereby the threading strip is tensioned when clamped.

11. The method of claim 10, wherein the knife is moveably mounted on the carrying device.

12. The method of claim 11, further comprising:

subjecting the threading strip to additional airflow via at least one air nozzle disposed on the counter support.

13. The method of claim 12, further comprising:

separating the threading strip from the remaining portion of the web with a separating device disposed on the carrying device, wherein the separating device comprises an engaging projection.

14. The method of claim 13, wherein the remaining portion of the web travels away from the carrying device after separating and wherein the threading strip is engaged by the engaging projection.

15. A method for cutting and transferring a threading strip from a web comprising:

conveying the threading strip and a remaining portion of the web into a basement area wherein a device is disposed;

guiding the threading strip into the device when the device is in a first functional position, the first functional position being defined by an open distance between a driven guide roll rotatable mounted to a carrying device and at least one clamping roll rotatably mounted to a counter support;

maintaining a distance between the threading strip and the driven guide roll, and maintaining a distance between the threading strip and the at least one clamping roll, whereby the threading strip travels unhindered in the first functional position;

first pivoting the carrying device towards the threading strip relative to a base of the device;

separating the threading strip from the remaining portion of the web by a separating distance using a projection;

second pivoting the carrying device toward the threading strip so that the driven guide roll contacts the threading strip, wherein the driven guide roll is rotating at a speed which substantially corresponds to a speed at which the web is moving;

third pivoting the carrying device towards the threading strip so that the threading strip is deflected toward the at least one clamping roll;

clamping the threading strip between the driven guide roll and the at least one clamping roll whereby the threading strip is tensioned;

cutting the threading strip with a knife to form a threading strip free end, wherein the threading strip is cut without a substantial reduction in the tension;

activating at least one air nozzle on a first guide device disposed on the carrying device to guide the threading strip free end to a second guide device disposed on the counter support;

guiding the threading strip free end on the second guide device;

further guiding the threading strip free end to a web guide roll using air flow which is generated by at least one air nozzle disposed on the second guide device.

16. The method of claim 15, wherein the knife is located before the driven guide roll, with respect to a web travel direction.

17. A device for cutting and transferring a threading strip from a continuous material web, which functions with a machine for producing the continuous material web, wherein said continuous material web is one of a paper or cardboard web, comprising:

a knife arranged downstream from a cylinder of the machine for producing the continuous material web;

at least one driven guide roll which is positioned to be brought into engagement with the threading strip;

at least one clamping roll which is positioned to be brought into engagement with the threading strip; and a mechanism for producing an air flow, wherein the threading strip is guided away from the continuous material web via the air flow after the threading strip is cut, and wherein the knife is arranged in an area between the cylinder and each of the at least one driven guide roll and the at least one clamping roll.

18. The device of claim 17, wherein the at least one driven guide roll functions as a clamping device.

19. The device of claim 18, wherein the at least one clamping roll is associated with a counter support which is stationary relative to a base.

20. The device of claim 19, wherein the counter support comprises a guide device.

21. The device of claim 20, wherein the guide device further comprises at least one of al least one guide plate and at least one air nozzle.

22. The device of claim 17, further comprising a base;

wherein at least one of a carrying device and a counter support is connected to the base.

23. The device of claim 22, wherein the base is at least one of moveable and rotatable.

24. The device of claim 17, wherein a rotation speed of at least one of the at least one driven guide roll and the at least one clamping roll is adjustably driven such that the rotation speed is at least as great as a traveling speed of the threading strip.

25. The device of claim 17, further comprising a pivotally mounted carrying device coupled to the knife.

26. The device of claim 25, wherein the knife is moveable relative to the carrying device.

27. The device of claim 25, wherein the at least one driven guide roll is rotatably supported on the carrying device.

28. The device of claim 27, further comprising a guide device comprising at least one air nozzle.

29. The device of claim 25, wherein the mechanism for producing an air flow is coupled to the carrying device.

30. The device of claim 17, wherein at least one of the at least one driven guide roll and the at least one clamping roll is movably supported.

31. The device of claim 17, further comprising a separation device which includes a projection for producing a distance between the threading strip and a remainder portion of the material web.

32. A device for cutting and transferring a threading strip downstream of a cylinder, comprising:

a carrying device;

a counter support;

a base for supporting the carrying device and the counter support;

the carrying device being pivotally mounted to at least one of the base and the counter support;

a knife;

a driven guide roll;

a first guide device;

the knife, the driven guide roll and the first guide device being coupled to the carrying device;

at least one clamping roll;

the knife being arranged in an area between the cylinder and each of the driven guide roll and the at least one clamping roll;

a second guide device;

the clamping roll and the second guide device being coupled to the counter support; and a mechanism for producing an air flow, wherein the threading strip is guided away from the continuous material web via the air flow after the threading strip is cut, and wherein the driven guide roll is mounted to move the threading strip towards the clamping roll.

33. The device of claim 32, wherein the base comprises a rotating joint for rotating the carrying device and the counter support.

34. The device of claim 32, wherein the base is moveable with respect to a surface on which it is mounted.

35. The device of claim 32, wherein a cutting edge of the knife is configured in a direction substantially parallel to a center axis of the driven guide roll.

36. The device of claim 32, wherein the first guide device comprises at least one air nozzle.

37. The device of claim 32, wherein the second guide device comprises at least one air nozzle and a guide plate.

38. The device of claim 32, wherein the at least one clamping roll comprises one clamping roll.

39. The device of claim 32, further comprising a web guide roll for guiding the cut threading strip away from the device.

40. The device of claim 32, wherein the counter support further comprises al least one side wall pivotally mounted to the base, the at least one side wall supporting one end of the clamping device.

41. The device of claim 40, wherein the second guide device comprises at least one air nozzle and a guide plate.

42. The device of claim 41, wherein the at least one clamping roll and the driven guide roll trap the threading strip disposed therebetween, wherein the guide plate and the at least one air nozzle are disposed on one side of the web.

43. The device of claim 32, wherein the carrying device further comprises at least one carrying arm pivotally mounted to the base, the at least one carrying arm supporting one end of the driven guide roll.

44. The device of claim 32, further comprising a piston/cylinder unit for pivoting the carrying device.

45. The device of claim 32, further comprising a doctor for guiding the web.

46. The device of claim 32, where the base is disposed in a basement area below a cylinder on which the web is disposed.

* * * * *